United States Patent [19]

Fetty et al.

[11] 4,217,727

[45] Aug. 19, 1980

[54] MINIATURE MONORAIL SYSTEM

[76] Inventors: Warren N. Fetty, P.O. Box 306; Rosabelle Fetty, both of P.O. Box 306, Altadena, Calif. 91001

[21] Appl. No.: 929,288

[22] Filed: Jul. 31, 1978

[51] Int. Cl.[3] ..... A63H 18/12

[52] U.S. Cl. ..... 46/257; 46/1 K; 104/120; 238/10 E; 105/145

[58] Field of Search ..... 46/1 K, 43, 257, 260, 46/258, 216, 259; 104/118, 120; 105/141, 145, 30; 238/10 E, 10 F, 10 R

[56] References Cited

U.S. PATENT DOCUMENTS

| | | | |
|---|---|---|---|
| 2,346,978 | 6/1939 | Lent | 105/141 |
| 2,836,129 | 5/1958 | Jaeger | 104/120 |
| 2,913,997 | 11/1959 | Wolf | 105/30 X |
| 3,041,983 | 7/1962 | Liversidge et al. | 46/260 X |
| 3,111,910 | 11/1963 | Pao | 105/145 X |
| 3,120,719 | 2/1964 | Simonds | 46/216 X |
| 3,263,364 | 8/1966 | Lindstrom | 46/260 |
| 3,487,999 | 1/1970 | Nash et al. | 238/10 E |
| 3,570,177 | 3/1971 | Tomaro | 46/260 |
| 3,603,505 | 9/1971 | Tsugawa | 238/10 E |
| 3,610,162 | 10/1971 | Lawrence | 104/120 X |
| 4,031,662 | 6/1977 | Beshany | 46/257 |

FOREIGN PATENT DOCUMENTS

| | | | |
|---|---|---|---|
| 916936 | 8/1954 | Fed. Rep. of Germany | 46/216 |
| 1118948 | 6/1956 | France | 46/259 |

*Primary Examiner*—Robert Peshock
*Assistant Examiner*—Mickey Yu
*Attorney, Agent, or Firm*—Christie, Parker & Hale

[57] ABSTRACT

A toy monorail system of the support type for vehicles such as miniature railway cars and slot cars. The monorail track consists of an elongated flat strip or length of plastic having flat metal conductors located in flanged recesses molded into each side of the strip or length. The track is edge-mounted and, on flat surfaces, is self-supporting. The system can be set up in an unlimited number of configurations and elevations. In use, the track is arranged either in a self-supporting configuration on floors, table tops and the like, or utilizes special supports which engage a slot or recess molded into one edge of the track. Various styles of vehicles are used with the system, including trains, automobiles, boats, and rockets. The drive vehicle is mounted on the edge of the track opposite the slotted or recessed edge. The vehicle utilizes a pair of shaped contacts to make electrical connection with the metallic conductors and a pair of drive wheels mounted on vertical axes for gripping the plastic monorail on each side at a point on the track below the location of the metallic conductors.

37 Claims, 20 Drawing Figures

MINIATURE MONORAIL SYSTEM

DESCRIPTION OF THE PRIOR ART

The present invention pertains to a toy vehicle system operating on a monorail principle and, specifically, a monorail system of the support type which uses a monorail track formed from a flat length of material, having an electrically conductive flat metal band slidably mounted and extending longitudinally along each side of the track.

The prior art contains a number of examples of toy monorail-type systems. Such systems include both support and suspension or overhead-type systems. Representative of such support systems are the toy monorail train system shown by U.S. Pat. No. 3,570,177 and the toy structural support system of U.S. Pat. No. 3,581,987. In addition, representative of an overhead or suspension-type of monorail system is the toy monorail trolley system of U.S. Pat. No. 3,041,983.

In the case of the overhead monorail system of the U.S. Pat. No. 3,041,983 patent, the vehicle is disposed from a vertically-oriented rail which combines support and conductive functions. Electrical and frictional drive contact is obtained by means of a single pair of rollers which are mounted on a vertical axis and grip the sides of the rail. The rail is constructed from a pair of conductive strips secured to and separated by an insulating strip of limited flexibility. Support for the vehicle of this system is provided from an overhead carriage which mounts a pair of aligned trolley wheels, each wheel having a pair of flanges defining an aligned slot which seats on the monorail.

The toy monorail systems of U.S. Pat. Nos. 3,570,177 and 3,581,987 are representative of the underlying support-type monorail systems. Here, the vehicle sits on top of or astride a monorail track in which a metallic conductor is mounted for providing electrical power to the vehicle. As is typical of support-type monorail systems, the track is not a thin, flat, knife-edge type of configuration, but rather is a relatively wide rod or segment of significant thickness in which conductors are embedded. The drive mechanism of the vehicle is a carriage, utilizing both drive wheels and idler rollers on which the vehicle is mounted, this configuration of support mechanism being utilized to maintain the vehicle in position on the track.

Such systems, of which the prior art above is typical, are characterized by a distinct lack of flexibility and modularity, severely limiting the amount of bending to which the monorail can be subjected and thus limiting the track configurations which can be achieved utilizing these monorails. In many instances, the limiting factor is the structure of the monorail itself which cannot be bent or curved beyond a certain limit without causing the electrical conductors to break or pull away from the insulating strips to which they are attached. In addition, because of the structure of the monorail, special supports are normally required. Typically, the total assembly is bulky and difficult to store because of the fixed, inflexible construction of the monorail. The cost of the system is also quite high due to the cost of the individual components and the materials from which the monorail is constructed.

SUMMARY OF THE PRESENT INVENTION

In contrast, the present invention is a monorail vehicle system of the support type which utilizes a flat, thin, highly flexible vertical rail for supporting the vehicle. This system is adaptable to use with all types of vehicles, but is particularly suited for use as a toy train system and as a slot car system.

The present invention provides a monorail system comprising a length of flat material defining a monorail having a recess extending longitudinally of the material on each side thereof. The material is relatively flexible about its lateral axis and relatively rigid about its longitudinal axis. The system includes a vehicle mounted on one longitudinal edge of the monorail. A flexible conductive strip is mounted in each recess, each strip being freely and independently slidable in its respective recess. Motor means are located within the vehicle and contact means are mounted on the vehicle for establishing electrical contact with the conductive strips for transmitting electrical power from the conductive strips to the motor means. Drive means are mounted on the vehicle which are in frictional contact with the monorail with means provided for transmitting mechanical drive force from the motor means to the drive means and additional means provided for transmitting electric power from a source to the conductive strips.

The present invention provides a monorail system which is characterized by a degree of flexibility and adjustability not previously achieved. Due to the inherent design limitations in previous monorail systems of the prior art, the bending and curving of the track of such systems has been extremely limited. This is due to the fact that in such prior art systems, the conductors are secured and rigidly held in place by their support means, whether the conductors are embedded in or attached to insulating supports. This means that only a limited amount of bending and curving can be sustained without causing the metallic conductor and the insulating support to separate due to the different coefficients of expansion. Once separation occurs, a number of operating problems are encountered, including loss of electrical contact and drive power to the vehicle.

The present invention provides a monorail system in which essentially unlimited numbers and types of track orientation configurations can be obtained, including spirals, sharp curves, abrupt changes of elevation and inclination and bridges over obstacles. Ease and economy of manufacture results due to the provision of a monorail which utilizes a simple extruded flat strip, preferably of plastic, as the insulating support for the conductors, having flanged recesses for slidingly receiving the metallic conductors to provide power to the vehicle. The sliding reception in flanged recesses of the metallic conductors means that the metallic conductors are freely movable in the recesses and, under bending and curving, actually creep in either direction relative to the flat plastic insulating support material to accommodate the desired track configurations.

The invention is also characterized, because of its simplicity of manufacture, with an ease of assembly and disassembly. It can be erected in many different locations and adapted to many room configurations. Other practical advantages also flow from the monorail system of the present invention, in that, because of the track flexibility, it is inherently easier to package, store and ship the system in much smaller volumes than has heretofor been the case. Another important feature of the present invention is that it is self-supporting and requires no external supports when placed on tables, floors, and the like. It can likewise be mounted on brackets attached to walls. The adaptability and flexibility of the invention is further illustrated, however, by the provision of a slot in the longitudinal edge of the monorail opposite the edge on which the vehicle rides for the reception of supports which permit the monorail system to be mounted on supports when desired, such as when providing a loop of a desired dimension or providing for a change of grade or elevation of the track. Such supports are likewise tiltable and can be positioned to support the track as it tilts and changes altitude through turns, curves and the like.

The plastic from which the flat strip is preferably fabricated is a polypropylene which combines the desired characteristics of easy extrudability while, at the same time, resulting in a monorail track which has the desired degree of flexibility about its lateral axis. In addition, there are available a number of adhesives which are suitable for use with polypropylene and in conjunction with the assembly of certain elements of the invention. In addition to polypropylene, however, styrene, polyvinylchloride and polyethylene have also been found to be suitable as the material from which the basic monorail track is fabricated.

DESCRIPTION OF THE DRAWINGS

These and other advantages of the present invention will be better understood by reference to the attached drawings wherein

FIG. 11 is a plan view of a track switching assembly for use with the invention;

DESCRIPTION OF A SPECIFIC EMBODIMENT

Figure 1:
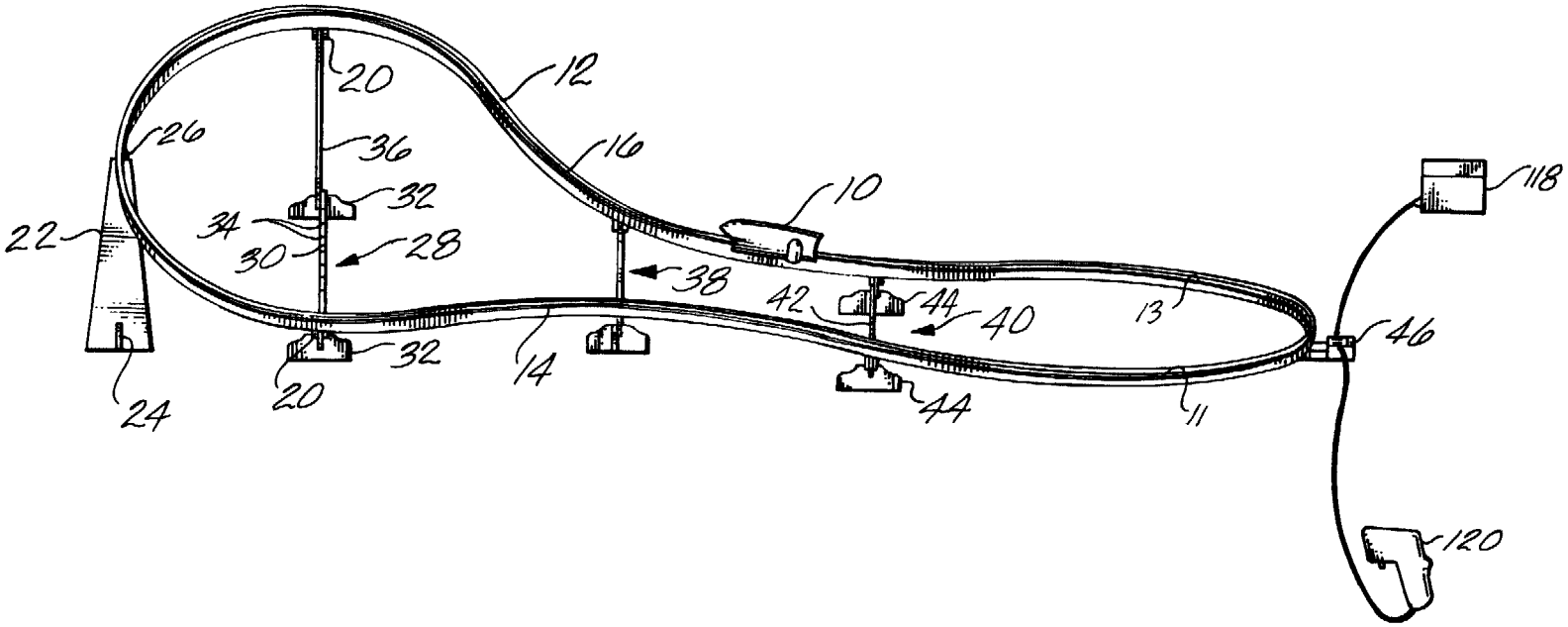
FIG. 1 is a perspective view of a monorail system according to the present invention.

The monorail system of the present invention is shown in FIG. 1 in one of the many configurations in which it can be arranged. As shown therein, the track arrangement is generally an elongated, closed, oblong shape in which the track undergoes several changes in elevation. The invention comprises a vehicle 10 mounted on one of the longitudinal edges of a thin, flat length of a non-conductive, high impact extruded strip or band 12 of plastic material which defines the monorail track. In its presently preferred embodiment, the track is approximately one-eighth of an inch thick and 1.5 inches high. A first thin flat metallic strip 14 is slidably received within a first flanged recess 11 molded into one side of the plastic monorail strip 12. A second thin flat metallic strip 16 is slidably received in a second flanged recess 13, on the other side of the strip 12. Both recesses extend along the entire length of the monorail track.

Figure 3:
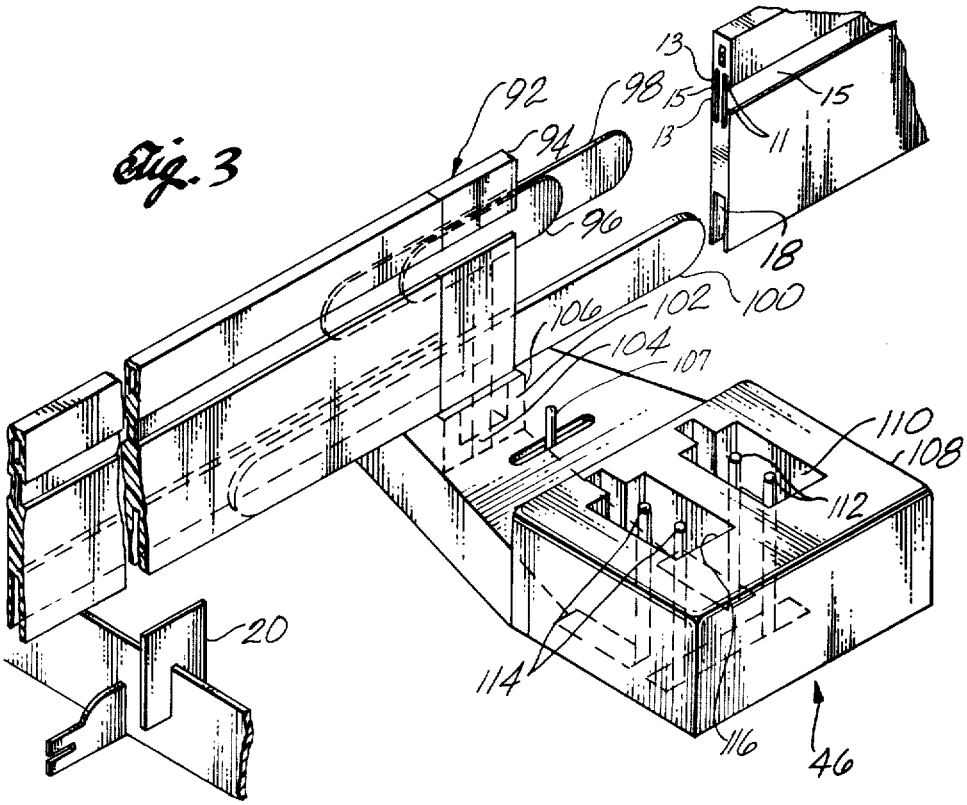
FIG. 3 is a fragmentary view in perspective of a typical juncture between sections of track of the monorail and the power take-off point.

A slot 18, shown in FIG. 3, extends the length of the monorail track in the bottom edge thereof. Slot 18 is adapted to receive an engaging tongue extension from adjacent sections of track or from adaptors used to join the ends of two lengths of the monorail. In addition, slot 18, opening outwardly from the bottom longitudinal edge of monorail 12, is also adapted to receive flat bladelike projections or tabs 20 which extend upwardly from supports for holding the track in position in its support configuration. As shown in FIG. 1, a number of different configurations of supports are provided, including an elevating support 22 mounted on a cross-shaped base 24 having a tab 26 secured at the upper end thereof for engaging the underside slot 18 on the monorail track. A cross brace-type support 28 is also provided, comprising an elongated member 30 extending between two flat blade-shaped bases 32. The elongated member 30 is provided with a number of slots 34 in the upper edge thereof for receiving flat track supporting tabs 20. One tab 20 is shown at one end of member 30 with its edge opposite the edge engaged in slot 34, engaging the underside slot 18 of the monorail track.

At the other end of elongated member 30, a vertical support 36 is mounted on blade-shaped base 32. Support 36 terminates in a flat tab 20 which engages the underside slot 18 of the track, and, in conjunction with support 22, holds the track in an elevated position. A similar, but shorter, elevating support 38 is provided approximately midway between the curved end portions of the elongated loop. The half of the loop on the side of support 38, opposite support 22, is essentially flat in configuration and is supported by a horizontal bracing structure 40 comprising a brace member 42 and two transverse flat tab supports 44 whose bottom edges engage slots in the upper edge of brace 42. The tab supports 44 engage the slot 18 on the underside of the monorail along their top edges.

Shown at the narrow end of the loop is a power take-off connector 46, the configuration of which will be described in more detail in conjunction with FIGS. 3 and 20. A speed controller 120 and a D-C transformer 118 are shown plugged into connector 46. An adapter assembly (FIG. 3) is mounted on connector 46 and provides mechanical support for and electrical contact to the monorail.

The conductive bands or strips 14,16 of metal are freely slidable in the flanged recesses 11,13 of the plastic monorail track to permit the bands to creep or slide in either direction to conform to the curved configuration desired for the monorail system. As is shown by the illustrations in FIG. 1 and FIG. 6, the monorail according to the present invention can be configured in an essentially limitless number of configurations. Because of the flexibility of track, it can be coiled into the shape of a spiral, as in FIG. 6, or it can be formed of one continuous length or a plurality of assembled sections to have the oblong configuration of FIG. 1. The flexibility of the monorail track also makes it possible to provide for significant changes in elevation as seen, for example, in FIG. 1, where the loop portion of the monorail at the end to which the power take-off is secured is at essentially the level of the floor or table on which the assembly is placed and the loop portion at the opposite end is substantially raised in elevation to a height of in excess of twelve inches.

As seen in FIGS. 1 and 3, the flat metallic conductors 14,16 are received in recesses 11,13 located adjacent the upper edge of the monorail track to provide a wide expanse of plastic surface below conductors 14,16 as a traction surface which is gripped by the power drive wheels on the vehicle or locomotive which is run on the monorail. As can be seen from the drawing, the monorail track of the present invention provides a number of functions, including mounting the metallic strip conductors for providing electric power to the vehicle, providing a load-bearing support, namely, the upper longitudinal edge of the track for rolling support of the vehicle to be run on the monorail and a traction surface (the sides of the monorail) for the movement of the vehicles backward and forward on the track. The monorail track also provides a means to guide the vehicle since the vehicle grips the track and follows its configuration, however arranged.

In the presently preferred embodiment, the track is of a plastic sufficiently flexible about its lateral axis so that it can be curved on six-inch radii and into curves of a number of different configurations and sufficiently rigid about its longitudinal axis to support the vehicle. In the presently preferred embodiment, the monorail track is one continuous length of an extruded high impact plastic, such as polypropylene, of a predetermined measurement and has an interface or adapter assembly which attaches to the free ends of the continuous length track to complete the mechanical and electrical connections.

In extruding the plastic track, the dimensions of flanged recesses 11,13 are arranged such that sufficient space is provided for receiving the metallic bands 14,16 themselves, fixed conductive end portions 15, and, in addition, the tongues or connecting extensions 96,98 on the interface or adapter assembly.

Figure 18:
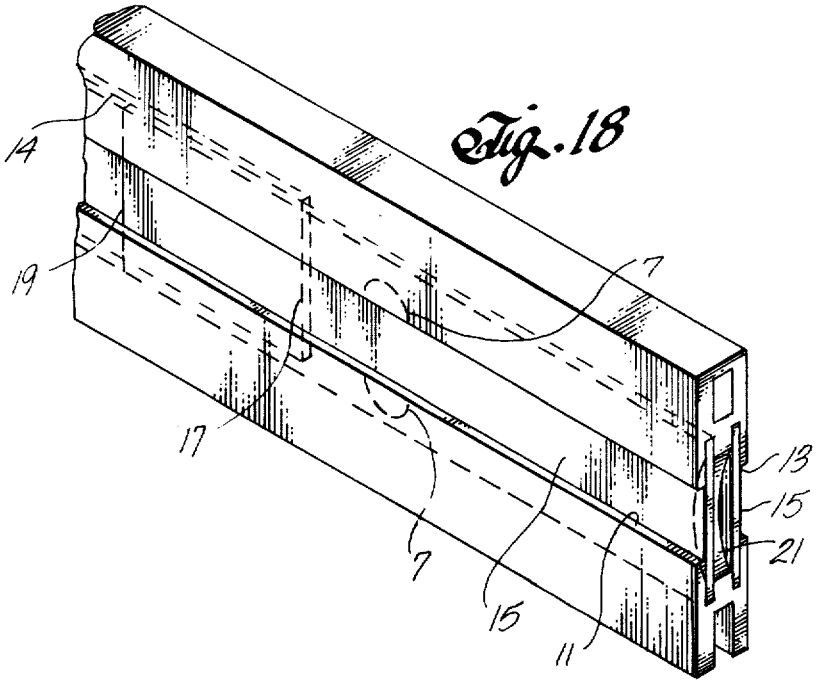
FIG. 18 is a perspective view of an end section of the monorail track according to the present invention.

As is shown in FIG. 18, the end of the freely slidable conductive strip 14 underlies the interior free end of a six-inch fixed metallic strip portion 15 located at the end of the monorail track section. The six-inch portion 15 is held fixed at its center by a small deposit of epoxy 7 placed between strip 15 and the upper and lower edges of the flanges of recesses 11,13. Alternatively, a wedge of plastic is forced under the recess flanges and made secure by solvent to lock strip 15 in position. The exterior free end of six-inch portion 15 is free to accept the metal tongue extensions 96,98 in sliding overlapping contact at its outer end. The six-inch section 15 is secured in position such that the exterior end is flush with the outer end of track 12.

As shown in FIG. 18, the freely slidable conductor 14 overlaps fixed portion 15 by a significant amount, on the order of one to three inches. The end of conductor 14 is shown at 17. The interior free end of fixed conductor 15 is shown at 19. As is also seen in FIG. 18, the web 21 between flanged recesses 11 and 13 is milled out in a semi-circle configuration at each end of the monorail under the fixed conductors 15. This facilitates the sliding engagement of the rounded ends of adapter extensions 96,98 with the fixed conductors 15 when the ends of the track are joined by the adapter assembly.

Figure 2:
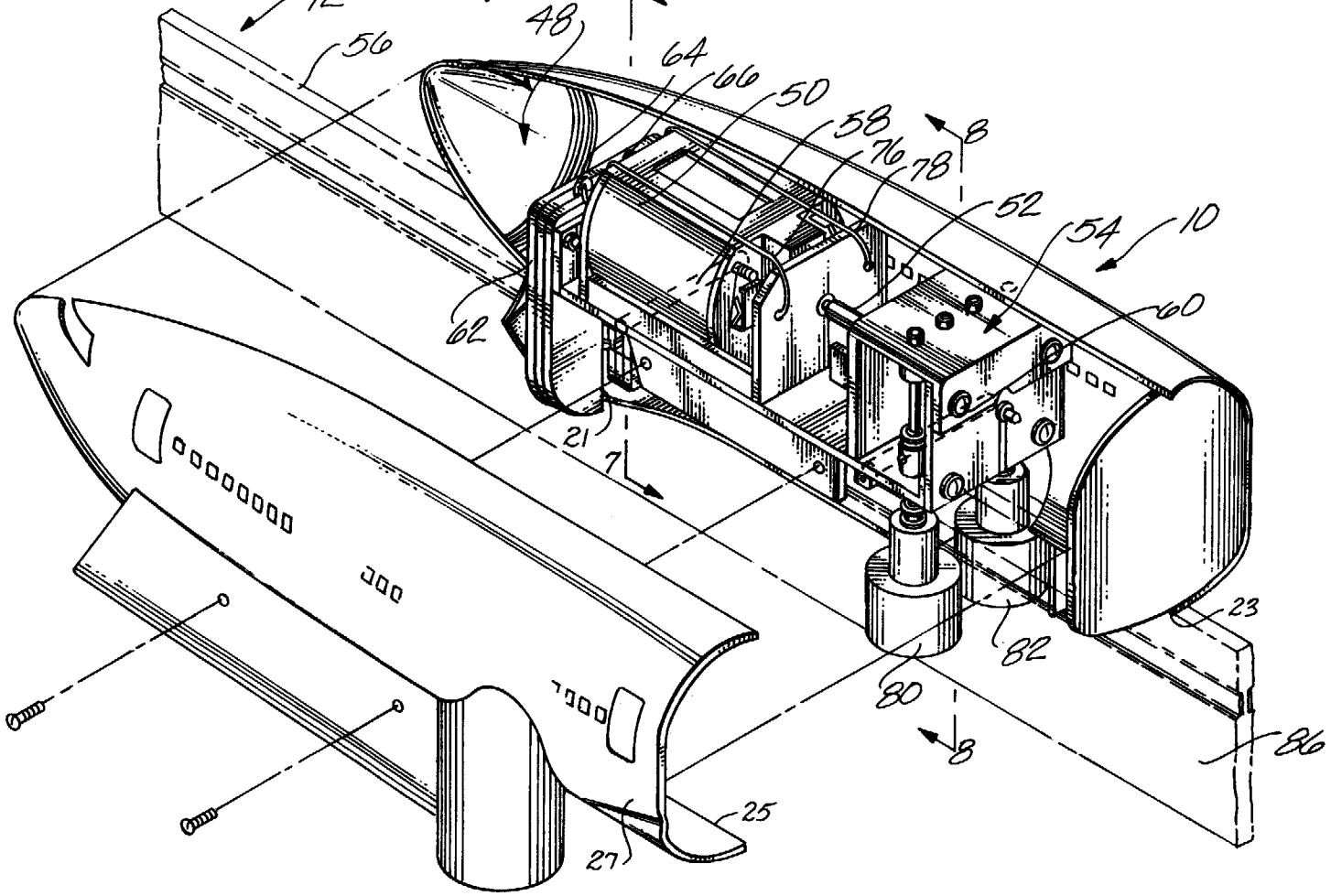
FIG. 2 is an exploded view of a vehicle used with the present invention.

A large, exploded view of the locomotive or drive vehicle 10 of the present invention is shown in FIG. 2. The interior of the vehicle includes several important subassemblies, including an electrical contact assembly 48 located at the front of the vehicle, a drive motor 50 located generally in the center of the vehicle, a drive shaft 52 extending rearwardly to a drive wheel gear assembly 54 located toward the rear of the vehicle. Basic support for the vehicle on the top edge 56 of the monorail track 12 is provided by a pair of horizontally disposed rollers 58 and 60 located adjacent the electrical contact assembly and the drive wheel gear assembly, respectively. Rollers 58, 60, are of a predetermined axial width greater than their diameters to permit shifting of the point of contact between the monorail and the rollers laterally as the vehicle passes along curved portions of monorail track. The lower edges 23,25 of the outer housing 27 of the vehicle are likewise spaced apart a sufficient distance to provide clearance from the rail as the vehicle passes along a curve.

Figure 7:
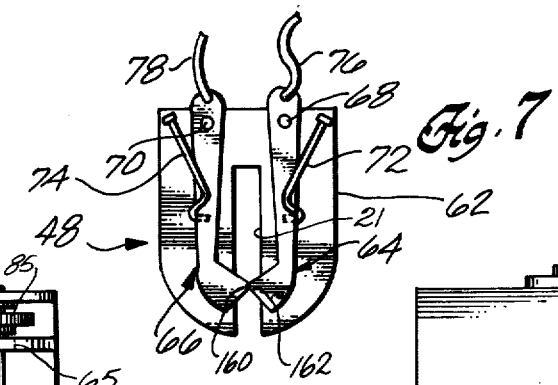
FIG. 7 is a sectional view of the yoke assembly portion of the vehicle of the invention taken along lines 7—7 of FIG. 2.

The electrical contact assembly 48 is also shown in elevation in FIG. 7 and comprises a housing 62 in which are pivotally mounted a pair of elongated contacts 64,66 extending longitudinally of the housing and terminating at their lower extremities in a pair of rounded point contacts 160,162. Contacts 64 and 66 are pivotally movable within assembly 48 about pins 68,70. Wire springs 72,74, secured at one end to the housing 62, exert pressure on and bias the rounded point contacts toward each other so as to physically contact and engage the metallic bands 14,16 in the monorail track in a secure electrical contact. Housing 62 is slotted at 21 in the center to give it a yoke-like configuration with the rounded point contacts of the assembly extending into the slot or space between the arms of the yoke. The slot 21 of the yoke provides the means whereby the vehicle is slidably mounted on and removed from the monorail when the vehicle is assembled to the track. The vehicle is mounted and removed from the rail at an angle to the horizontal to facilitate the slipping of contacts 160,162 onto and from the monorail structure. Electrical conductors 76,78 connect contacts 64,66 to the power input points to the motor.

Figure 8:
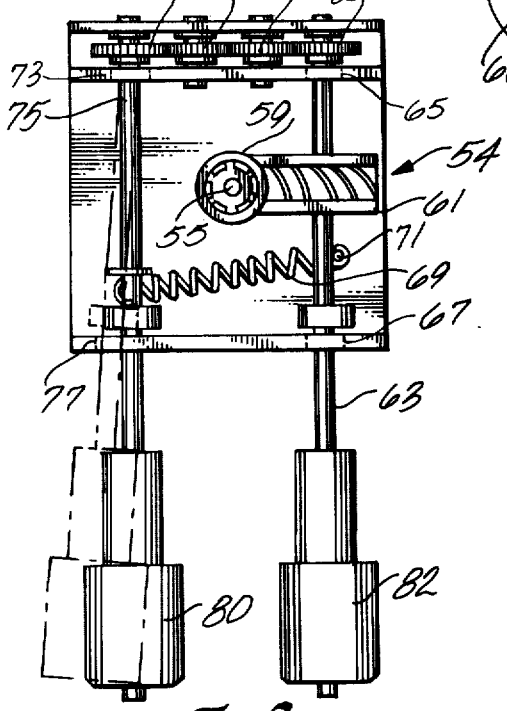
FIG. 8 is a sectional view of the vehicle taken along lines 8—8 of FIG. 2.

Electrical energy supplied from a power source is transmitted through the conductive bands 14,16 to the contacts 64,66 and through the conductors 76,78 to motor 50. When drive energy is supplied to motor 50, drive shaft 52 is rotated. The drive shaft is engaged with the drive wheels 80,82 depending from the drive assembly 54 on vertically suspended axles 75,63 as seen in FIG. 8. Power is transmitted by drive shaft 52 to axle 63 on which primary drive wheel 82 is mounted by means of a worm gear connection. Secondary drive wheel 80 is biased by means of a coil spring 60 in the direction of drive wheel 82. The pair of wheels 80,82 thereby grip traction surface 86 on the monorail to provide the means whereby the vehicle is moved along the track. Drive wheels 80,82, rotating about their axes under drive motor 50, thereby propel the vehicle in forward or reverse, depending upon their direction of rotation. Their direction of rotation is controlled by the direction of rotation of motor 50. The coil spring, biasing drive wheels 80,82 into engagement with the traction surface 86 of the monorail, produces a strong and secure grip between the rubber wheels and the traction surface.

Slot 21 in the yoke frame, and specifically the inside surfaces thereof, slide along either side of the monorail track surface to guide the front end of the vehicle. Slot 21 also provides the means whereby the front end of the vehicle is held upright on the monorail track. The power wheels 80,82, disposed about and extending downwardly over a substantial portion of the height of the monorail track provides a yoke-like means for supporting the rear end of the vehicle on the track, even in configurations where the track is twisted or angled over at 45° or more.

As indicated above, drive wheel 80 is biased toward drive wheel 82 by coil spring 69 which extends between shaft 75 and a pin 71. This spring biasing causes both wheels to be pulled into maximum frictional engagement and traction with the monorail track. The wheels 80,82 are of a wide configuration providing a large contact surface for enhancing the grip on the sides of the track. In the preferred embodiment, the wheels are made of non-slip rubber or rubber-like material with the lower end of each wheel being beveled. Wheel 82 has its shaft supported by two fixed bearings 65,67 to secure and fixedly mount drive wheel 82 and to keep the rear of the vehicle mounted upright on the track. Drive wheel 80 has its shaft 75 mounted through one fixed bearing 73 and one slotted bearing 77 to provide movement of the axle in the transverse direction, permitting wheel 80 to be spread apart from wheel 82, to aid in the slidable mounting and removal of the vehicle from the monorail track. The beveling of the lower ends of the wheels 80,82 also facilitates the mounting of the vehicle guiding the wheels downwardly onto the track when the vehicle is moved forward and downward in the mounting procedure.

Although both wheels are shown with a geared connection from the drive shaft to the motor, in another embodiment contemplated by the invention, one wheel is gear-driven and the second is arranged in an idler configuration which follows the rotation of the driven wheel.

Figure 20:
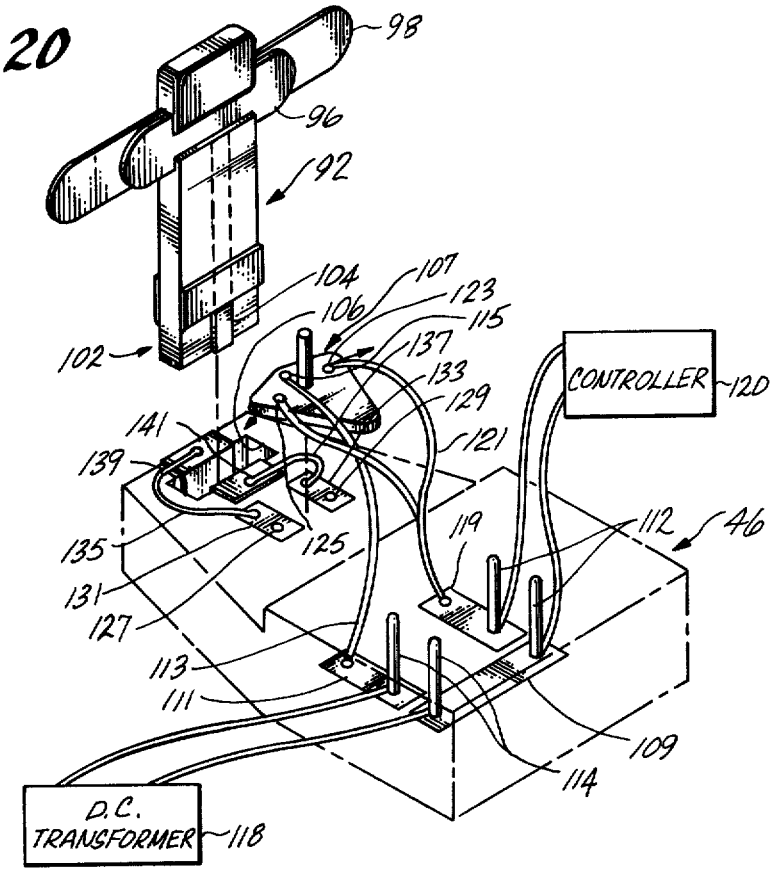
FIG. 20 is a fragmentary perspective view of the power take-off illustrating the electrical connections through the power take-off to the monorail track adapter assembly.

The adapter assembly or interface module 92 for joining ends of the monorail track is shown in FIGS. 3 and 20. As shown therein, assembly 92 comprises support element 94, a pair of conductive, tongue-shaped extensions 96,98, mounted in the upper portion of element 94 and extending transversely and outwardly beyond the edges of support 94 a predetermined distance. Extension 96 is considerably shorter than extension 98 and both are positioned on support 94 so as to register and slidably engage with the metallic end strips 15 secured in the longitudinal flanged recesses provided in the top portion of the monorail.

A third extension 100 is provided extending transversely of support 94 at its base and can be conveniently fabricated of the same material from which support 94 is fabricated. Extension 100 also extends beyond the edges of support 94 and is positioned so as to register with and slidably engage slot 18 in the bottom edge of the monorail track sections to be joined. To connect the assembly 92 to the ends of the monorail track, extension 100 is inserted first in slot 18 up to the free end of extension 98. Extension 98 is then guided under metal strip 15. Extensions 100,98 are then slid inwardly until the free end of conductor 96 reaches the end of the monorail. Extension 96 is then guided under the other metal strip 15 at which time all elements are pushed in flush.

The base of support 94 has an extension 102 to which is secured a pair of vertical conductors 104. Conductors 104 extend upwardly through support 94 to make electrical contact with conductive extensions 96 and 98. Extension 102 is adapted to be received in and supported by a recess 106 in power take-off base 46.

As seen in FIG. 3, base 46 has two sockets or receptacles 110,116 with electrically conductive pins 112,114 disposed therein. Receptacle 110 is adapted to receive a plug from a power source 118, such as a stepdown D-C transformer, which is, in turn, connected to a conventional source of power, such as 110 v power outlet. Receptacle 116 is adapted to receive a plug from a controller 120, such as the type of hand-operated slide wire potentiometer used in controlling slot cars. Controller 120 determines the amount of power that is supplied to the electrical conductors in the monorail and, thus, controls the speed and pulling power of the vehicle.

The details of the electrical circuitry from power connector 46 to the adapter assembly 92 are shown in FIG. 20, an exploded view of the power take-off base 46 and the adapter assembly 92. By means of a plug-ended connector, D.C. transformer 118 is connected to pins 114 in socket 116. Slide wire controller 120 is connected by means of a plug-ended connector to pins 112 in socket 110. The first pins 114,112 in sockets 116,110 are interconnected by conductive strip 109. The second pin 114 in socket 116 is electrically connected to a conductive strip 111 which is, in turn, connected by wire 113 to contact 115 on forward-reverse switch 107. The second pin 112 in socket 110 is electrically connected to a conductive strip 119 which is, in turn, connected by wire 121 to contacts 123,125 on switch 107. When switch 107 is operated, a pair of contacts 123,115 or 115,125 are alternately electrically connected by switch 107 to contacts 127,129 on conductive strips 131,133, respectively, to cause the monorail vehicle to be driven in forward or reverse, depending on the set of contacts connected in the circuit. Strips 131,133 are connected by wires 135,137 to contacts 139,141 in receptacle or recess 106. Contacts 139,141 extend downwardly into recess 106 and provide sliding electrical contact with the pair of vertical conductive strips 104 on support extension 102. Strips 104 are partially encapsulated by support 94 and extend vertically upward through support 94 until electrical contact is established with conductive extensions 96,98, respectively.

As shown in FIG. 3, the adapter assembly is already engaged at one side thereof with the track and is shown in position to be engaged with the other end of the monorail track. The conductive extensions 96,98, as well as the extension or arm 100, located at the bottom of assembly 92, which engages slot 18 when the track ends are assembled to the adapter unit, provide a strong, secure mechanical and electrical connection at each end of the track and also provide the means whereby the track is kept in alignment. Where an adapter assembly, such as assembly 92, is used solely as an interface between track sections, the configuration is similar except for omission of the vertical conductors which extend down to and make contact with the electrical connections in the power take-off base 46.

Figure 5:
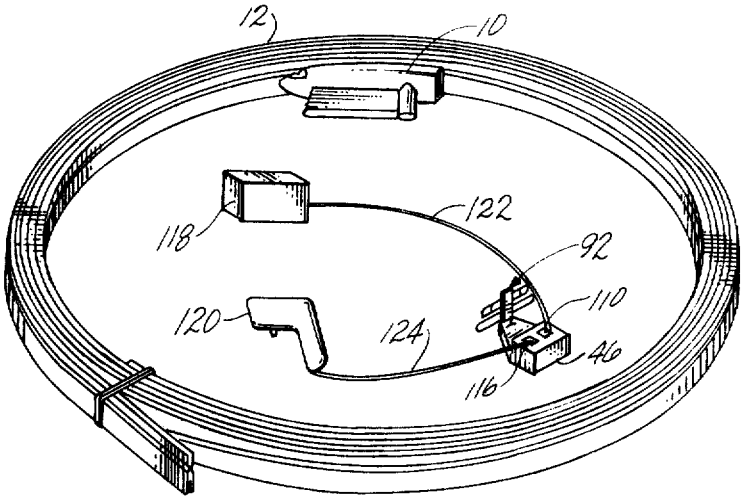
FIG. 5 is a perspective view of the monorail system in its packed, unassembled configuration.

A particular advantage of the present invention is that, due to the flexibility of the monorail track and the unique way in which the conductors are slidably supported in and mounted by the monorail, the total assembly can be disassembled and the track coiled up on a diameter of as small as twelve inches, allowing the entire unit to be stored in a very small, compact container. This aspect of the invention is illustrated in FIG. 5 wherein a length of coiled rail 12 is shown together with a locomotive 10, adapter assembly 92, a power take-off base 46, a power source 118 and a hand-held controller 120. Plug-ended cables 122,124 extending from the transformer and the controller provide the means whereby the power source and controller are connected to the sockets 110 and 116 on base 46. Since all accessory support pieces, namely, vertical supports 144,146,148, 150, base element 152, and risers 154,156, and any additional pieces used are formed from flat stock, they are easily packaged in a twelve to fourteen inch size container, such as shown in FIG. 5, together with the other elements shown therein.

Figure 4:
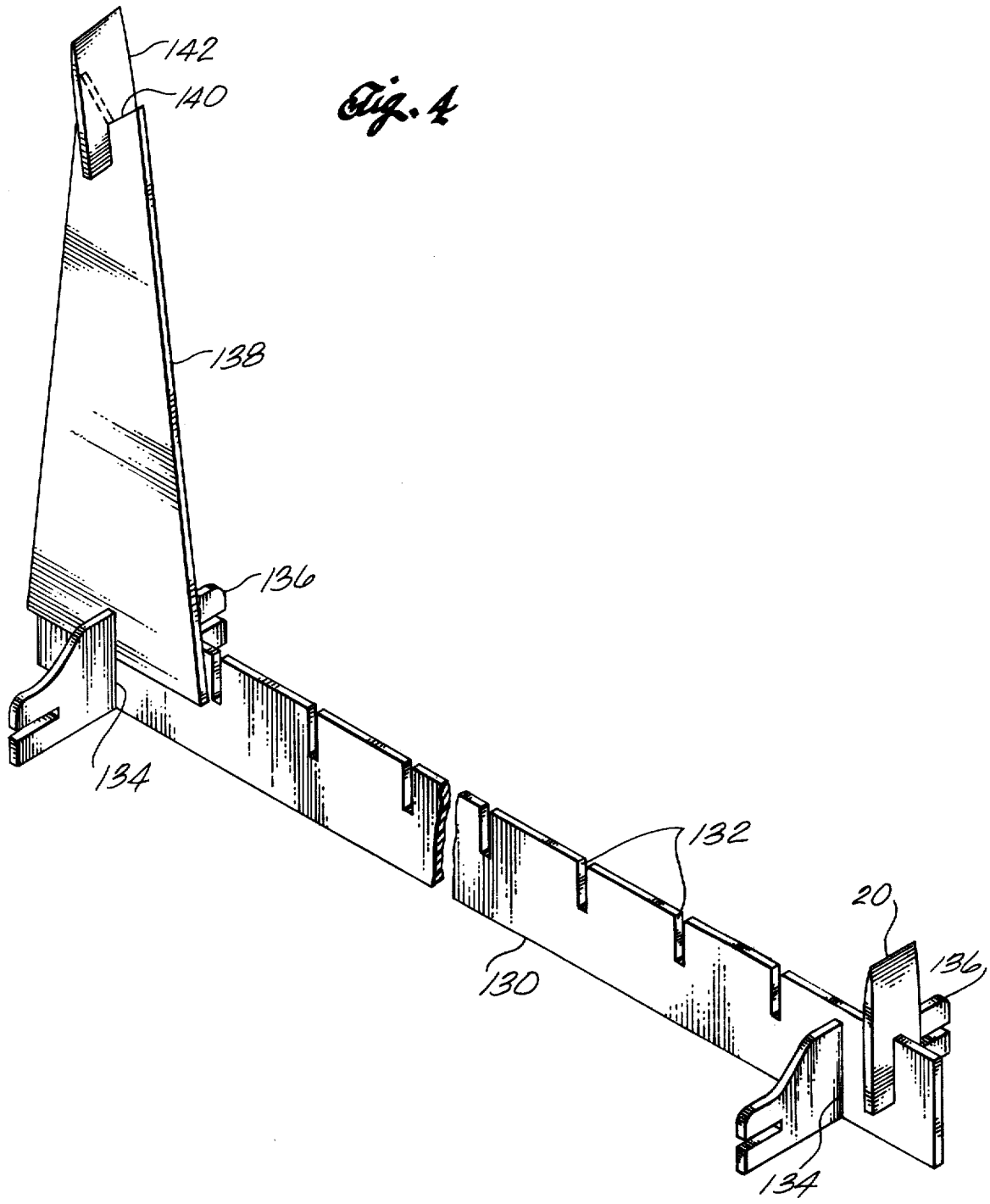
FIG. 4 is a perspective view of a typical supporting element for the support of the monorail.

The details of a typical elevating support for the monorail are shown in FIG. 4. As shown therein, the support comprises a flat, elongated base member 130 which has a configuration of a flat strip with transverse slots 132 located at spaced intervals along the top edge. Adjacent the ends of the member 130 are a pair of transverse slots 134 extending upwardly from the bottom of the member 130 for receiving cross-bracing supports 136 which are likewise slotted from the top to engage slots 134. In one embodiment, a vertical riser 138 is bonded or secured to strip 130 and extends upwardly to a V-shaped crown portion 140. A slotted top blade 142 is mounted in the notch of the V at the top of crown portion 140 permitting the blade 142 to be pivoted through an arc of approximately 60° so as to engage the slot on the underside of the monorail, whether its orientation at that point is flat, curved or tilted.

Figure 6:
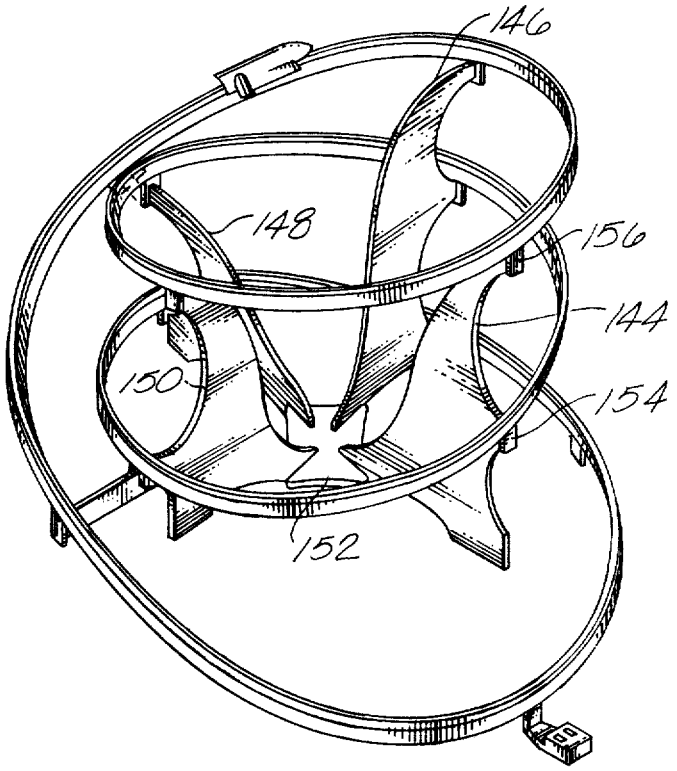
FIG. 6 is a perspective view of still another configuration of the monorail system according to the present invention.

As indicated previously, the possible configurations of the monorail setup using the present invention are essentially limitless. Shown in FIG. 6 is a spiral which is curved on a diameter of fourteen inches and rises to a height of approximately twenty-four inches. The drive power available from the conventional power source is sufficient to drive the vehicle of the present invention up a slope as steep as 45° and the monorail vehicle of the present invention is capable of driving its vehicle up and down a spiral such as is shown in FIG. 6. The spiral configuration comprises four vertical supports 144, 146, 148 and 150, respectively. These supports are joined by means of horizontal slots to a base element 152, shaped generally in a four leaf clover configuration having slots bisecting each corner or leaf of the element. The slots in base element 152 engage the slots in the four vertical supports to provide the stand upon which the monorail is mounted. As is shown in FIG. 6, support 144 has two arms extending upwardly and outwardly from the center of the spiral which terminate in vertical blade risers 154,156. Blades 154 and 156 engage the slot on the underside of the monorail. Similarly, supports 146, 148 and 150 have two or more arms extending upwardly and outwardly, terminating in blade risers which engage other portions of the slot in the bottom of the monorail to provide support.

Figure 9:
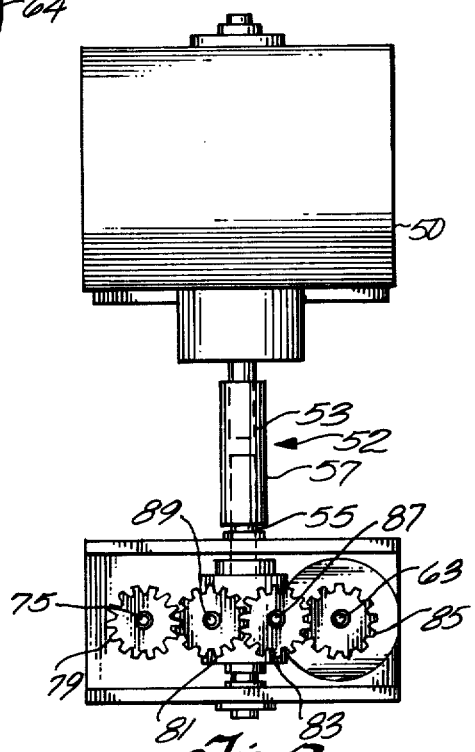
FIG. 9 is a top view of the motor and power drive linkage of the vehicle.
Figure 22:
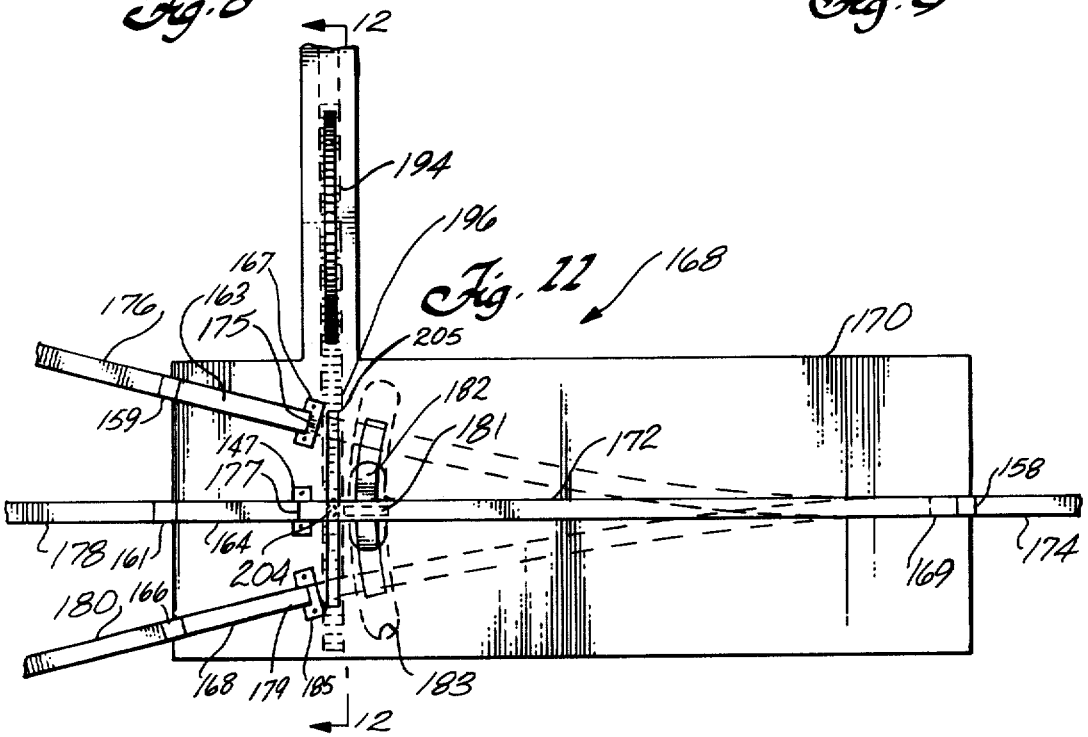

The drive assembly 54 is further illustrated in FIGS. 8 and 9. Motor 50 is mounted with drive shaft assembly 52 extending rearwardly. The drive shaft assembly 52 comprises a motor drive shaft 53 and a gear assembly drive shaft 55, which are coupled together by means of a rubber tube coupling 57. The rubber tube coupling eliminates alignment problems. Shaft 55 mounts worm drive gear 59 and transmits rotational drive power to driven worm gear 61 which is mounted on shaft 63 which, in turn, mounts primary drive wheel 82. Shaft 63 is held in alignment in gear assembly 54 by means of fixed bearings 65,67. Shaft 63 depends vertically downward from the vehicle and is oriented at a 90° angle to the top edge of the monorail to insure that the power wheels drive along the traction surface of the monorail in a straight line.

Drive wheel 80 is held under tension by means of spring 69 which is biased toward shaft 63 by pin 71. The opposite end of spring 69 is attached to shaft 75. Shaft 75 is movable outwardly as shown by the ghosted position of the shaft and wheel 80. Spring 69 keeps wheel 80 in firm contact with one traction surface of the monorail and, in effect, squeezes wheel 80 toward wheel 82 to produce positive traction by both wheels on each side of the monorail. Shaft 75 is free to move in slot bearing 77 to facilitate the mounting and removal of the vehicle from the monorail. As better seen in FIG. 9, drive power from shaft 55 is transmitted to secondary drive wheel 80 by means of gears 79, 81, 83 and 85, thus causing both drive wheels 80,82 to move forward or backward on the track. Gear 85 is rigidly secured on shaft 63 and, when the monorail moves forward, turns counterclockwise. Gear 83, mounted between gears 81 and 85, rotates about axle pin 87 and rotates in a clockwise direction causing gear 81 to rotate about pin 89 counterclockwise to thereby rotate gear 79 and shaft 75 to which it is secured in the same direction of rotation as shaft 63 and wheel 82.

Figure 10:
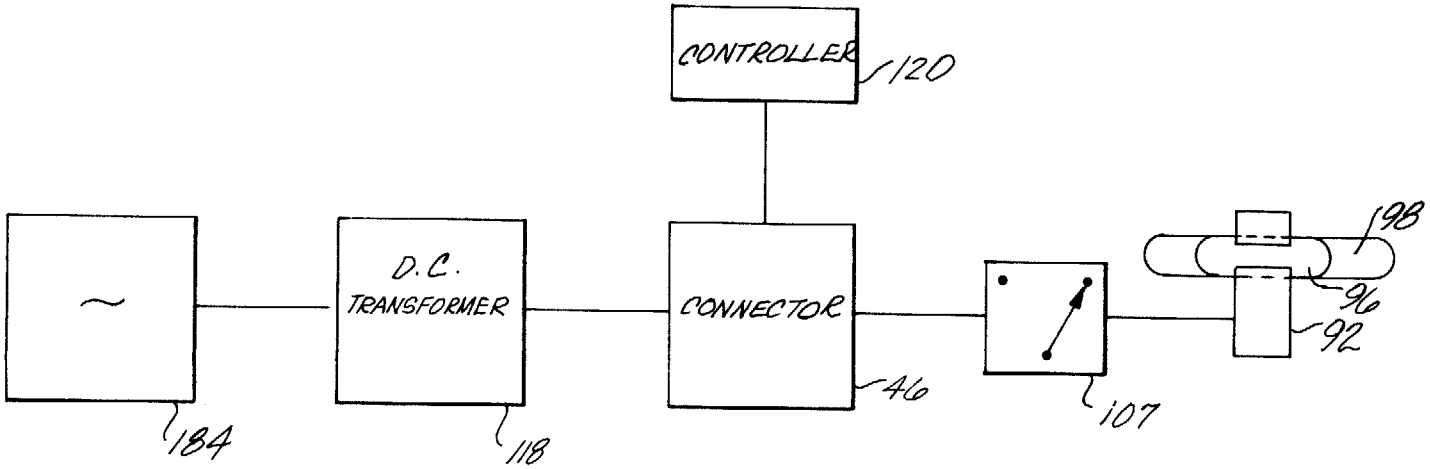
FIG. 10 is block diagram of the electrical circuit of the present invention.

A block diagram in FIG. 10 illustrates the electrical circuitry of the present invention. As shown therein, a source of line voltage 184 is connected to D-C transformer 118, which is, in turn, connected to a power take-off connector, such as connector 46 of FIG. 3. In one embodiment, transformer 118 provides a 6-volt direct current output which is transmitted through the conductive strips of the monorail to the D-C motor on the vehicle. A speed controller, such as hand-held controller 120, is also connected to connector 46. Speed controller 120 comprises a rheostat which, in the preferred embodiment, is hand-operated by the operator of the monorail invention to increase or decrease the amount of power supplied to the vehicle of the invention to thereby control the speed. The output of the distribution connector 46 is transmitted through a reversing switch 107 which controls the direction of movement of the vehicle. Switch 107 is movable between two positions conforming to the forward and reverse motion of the vehicle. The output of switch 107 is, in turn, connected to the adapter or interface module assembly 92 which supports the pair of metallic conductive extensions 96,98 which are telescopingly received into the ends of the monorail track at the junction point.

Figure 12:
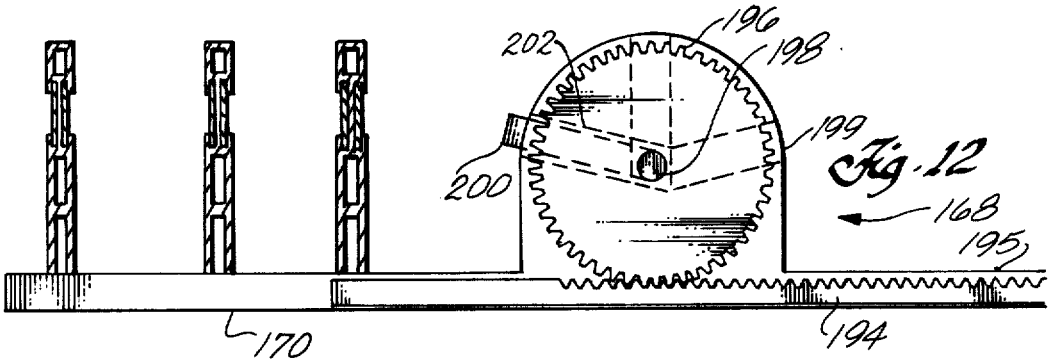
FIG. 12 is a sectional view taken along lines 12—12 of FIG. 11.

A switching assembly 168 for use with the monorail track of the present invention is shown in FIGS. 11 and 12. The switching assembly is mounted on a base plate 170. A flexible pivotable section of rail 172 is attached to base plate 170 at the end opposite the location of the switching tracks. Rail 172 is pivotable transversely of plate 170 using, as a pivot point, the point of attachment 169 to base plate 170. The switching assembly 168 connects to a regular track section 174 adjacent the fixed end of rail 172. Connection is made by a slidable adapter or interface module, such as assembly 92 shown in FIG. 3.

Three tracks, 176,178 and 180 are the tracks to which the vehicle of the invention can be switched by assembly 168. Short lengths of monorail track 163,164,165 are affixed to baseplate 170 and are connected to tracks 176,178,180 by means of adapters 159,161,166. The pivotable section of rail 172 is moved into alignment with a selected one of the three short tracks 163,164,165, depending upon the track to be switched to by means of the gearing arrangement described below. The abutment points of track 172 with short fixed sections 163,164,165 are shown at 175,177,179. A conductive plate 147 is shown attached to the baseplate 170 bridging the abutment point 177. Similar conductive plates 167,185 underlie abutment points 175,179.

Track 172 is secured to a stabilizer plate 182 which moves in a flange recess 183. Attachment of rail 172 to plate 182 is by means of a blade 181 which is attached to plate 182 and extends upwardly and into the slot recess 18 on the underside of track 172. As the free end of track 172 is flexed relative to its pivot point 168, whereby switching to track 163,164 or 165 is accomplished, plate 182 maintains the orientation of track 172 exactly at a 90° relationship to base plate 170 to assure true alignment of the juxtaposed sections of track.

A movable gear rack 194 is located in a recess 195 extending to the side of base plate 170. Gear rack 194 is moved by a circular gear lever 196, which is mounted on an axle 198 above rack 194 in housing 199. A handle 200 is provided which moves lever 196 between three positions, right, left and center, corresponding to the one of three tracks with which switching track 172 is to be aligned. A recess 202 is provided in housing 199, which handle 200 is snapped into and out of to hold the track securely at one of the three selections.

A pin 204 is vertically secured to the end of gear rack 194. Pin 204 extends upwardly through slot 205 into the slotted recess 18 at the bottom of track 172. As the gear rack 194 is moved, pin 204 causes track 172 to follow and align with one of the switching tracks to be selected. The transmission of electric current through the switching assembly is accomplished by wires extending from the metallic bands in the sections of rail down through the ends of the switching tracks to conductors which are mounted on base plate 170 and which bridge the gap between abutting sections of track segments.

Figure 19:
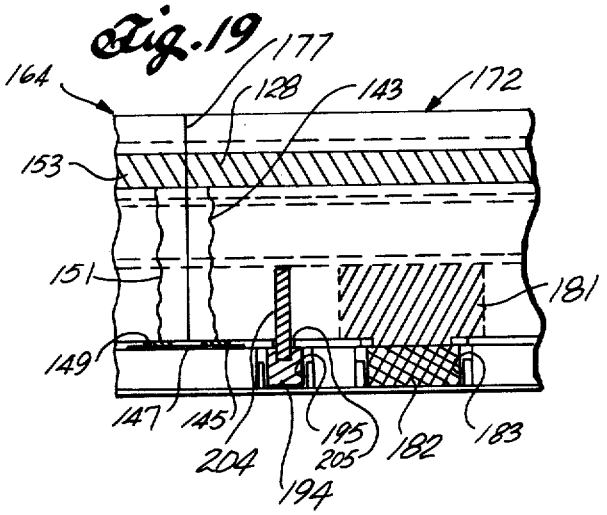
FIG. 19 is an elevation view of a portion of the switching assembly of FIG. 11, illustrating the electrical connections through the switch.

The continuity of the electrical connections between adjacent end sections of the abutting track segments of the track switching assembly of FIG. 11 is shown in FIG. 19. The point of abutment 177 marks the point of physical adjacency of track portion 164 and movable track section 172. Electrical power is transmitted from fixed main metallic strip 128 to a wire 143 which extends from strip 128 through a hole drilled in the monorail material downwardly to a sliding terminal strip 145 attached to the bottom of and extending transversely of track 172 to a predetermined point beyond each side of the track. A similar wire connection is provided on the side of track 172 opposite wire 143. This connection likewise extends from the fixed main metallic strip in the flanged recess on the opposite side of the monorail to the sliding terminal strip 145.

A conductive plate 147 with which terminal strip 145 is in sliding electrical contact extends under and across the point of abutment 177 at the switching point to a fixed terminal strip 149 located below and attached to track section 164. A conductive plate (not shown) similar in all respects to plate 147 is located on the opposite side of track 172 and extends across the point of abutment 177 between terminal strips 145,149 and makes electrical contact with both of said terminal strips. A wire 151 extends upwardly from strip 149, through a hole drilled in the monorail material, along the inside of track 164 to a fixed main metallic strip 153 located in the flanged recess on track portion 164. A similar wired connection exists on the opposite side of track 164. Electrical energy is transmitted to strip 128, passes through wire 143, terminal strip 145, plate 147, terminal strip 149, and wire 151 to strip 153 to provide electrical continuity through and bridge the point of abutment at track switching locations. A similar electrical path is provided on the insides of track sections 172,164 opposite that shown in FIG. 19.

The elevation view of the track switching location of FIG. 19 also depicts in section the movable gear rack 194 and pin 204 secured in rack 194. Similarly, the relationships of blade 181 and stabilizer plate 182 are also shown in FIG. 19. As shown therein, rack 194 moves in a channel 195 and plate 182 moves in a channel 183 as movable track section 172 is moved between the three switching options shown in FIG. 11.

Figure 14:
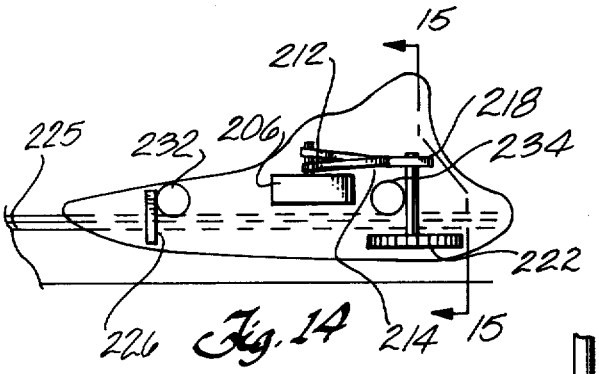
FIG. 14 is a side elevation view of a vehicle utilizing the drive system of FIG. 13.
Figure 15:
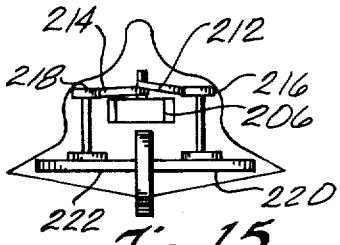
FIG. 15 is a view taken along lines 15—15 of FIG. 14.
Figure 13:
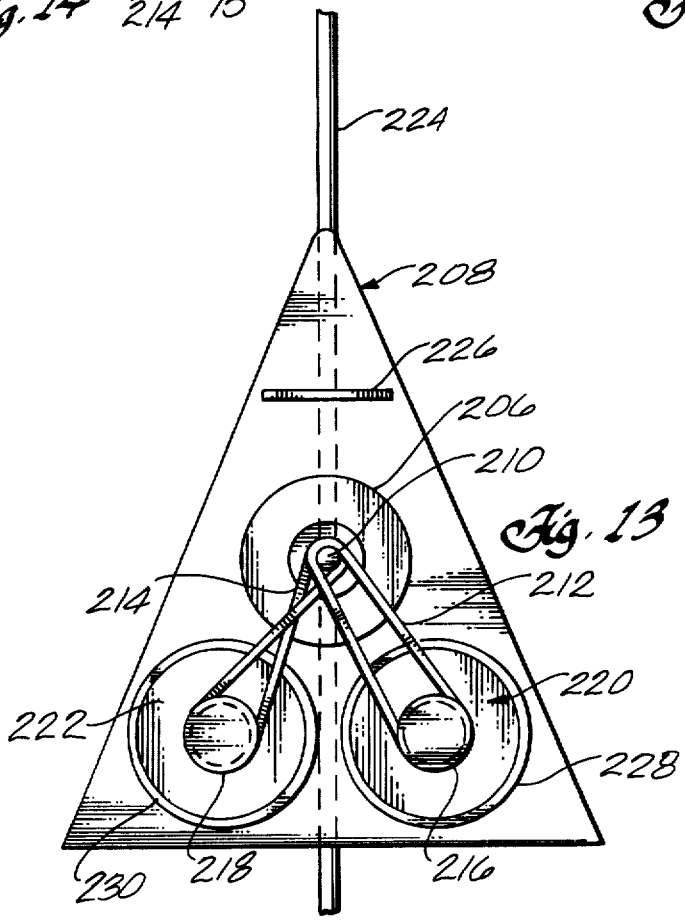
FIG. 13 is a plan view of an alternate embodiment of a drive system for use with a vehicle in the monorail system of the present invention.

In addition to the worm gear drive arrangement as described in conjunction with FIGS. 8 and 9, other drive arrangements also contemplated by the present invention are shown in FIGS. 13, 14 and 15. FIG. 13 is a plan view of such an alternate drive arrangement. A motor 206 is mounted on the bed of a vehicle 208. A drive shaft 210 extends upwardly from motor 206 which is engaged by belts 212 and 214, which, in turn, engage and extend around driven pulleys 216,218 mounted on drive wheels 220,222. As shown, the drive wheels 220,222 are in frictional engagement with a monorail track 224 upon which the vehicle 208 is mounted. Electrical contact is made with metallic bands or strips 225 in the monorail 224 by means of contact assembly 226. As is shown in FIG. 13, drive belt 212 is installed on pulley 216 and extends around drive shaft 210 without a twist. Belt 214 extends around pulley 218 and is twisted one-half turn to the right and placed over motor drive shaft 210. Both drive wheels 220,222 now exert motive force to both sides of the track to drive the vehicle in the same direction.

Further details of the vehicle of FIG. 13 are shown in FIGS. 14 and 15 which are a side elevation of the vehicle 208 of FIG. 13 and a sectional view therethrough respectively. As shown, the vehicle is one which is adapted for either highspeed travel on the monorail over a flat layout or with several changes in elevation, as in FIGS. 1 and 6, at reduced speed. The speed of the vehicle is determined in part by the use of large diameter wheels 220,222. The larger the wheels, the higher the speed. Attached to the perimeter of the wheels 220,222 are rubber treads 228,230 for maintaining a high degree of traction with respect to track 224. Two support wheels 232,234 are disposed on horizontal axes for providing basic support for the vehicle on track 224.

Figures 16, 17:
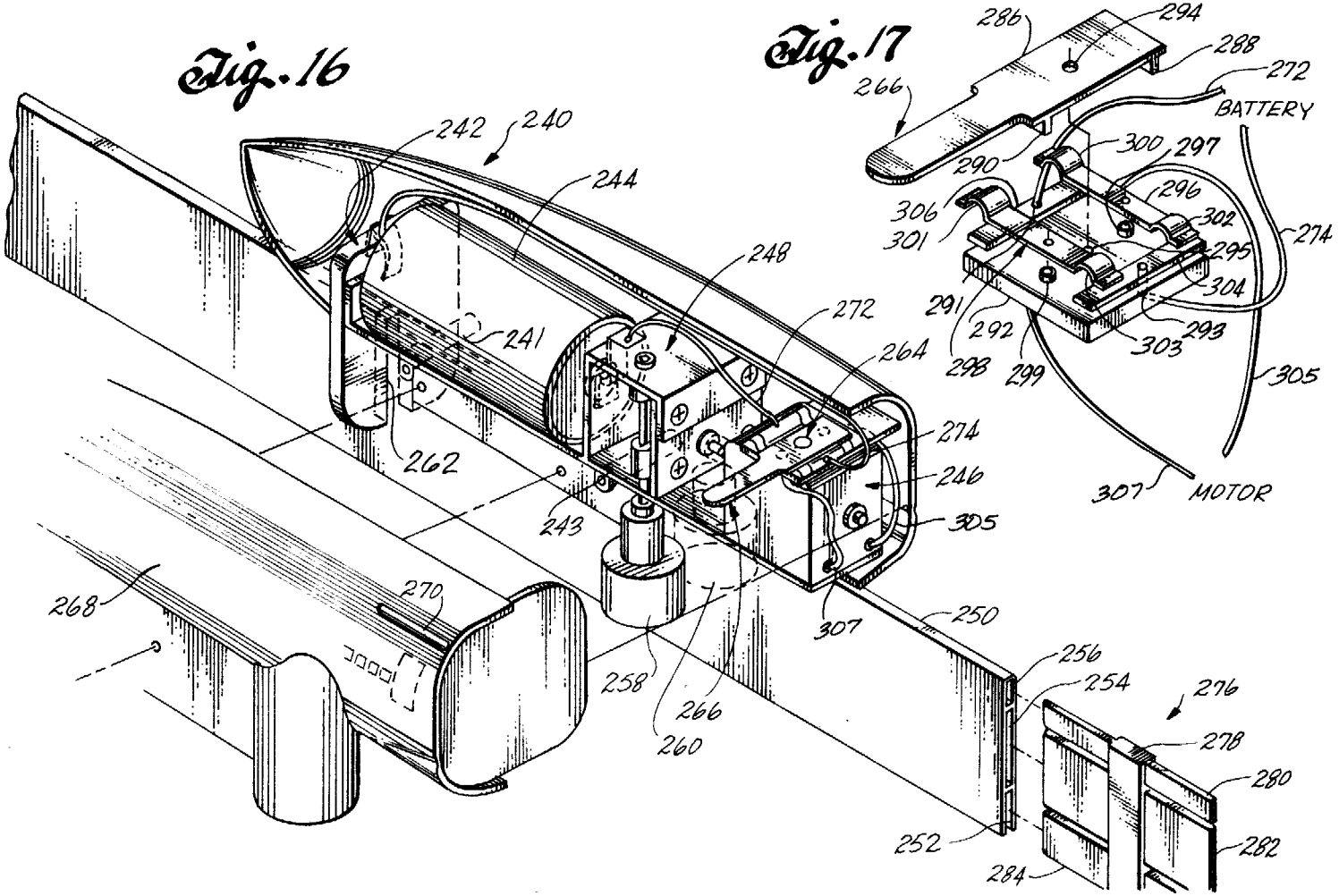
FIG. 16 is an exploded perspective view of a battery-powered vehicle according to the present invention.
FIG. 17 is an exploded perspective view of the switch assembly of the vehicle of FIG. 16.

A battery-powered version of the vehicle of the monorail system of the present invention is shown in FIG. 16. An enlarged perspective view of the control switch assembly used with this vehicle is shown in FIG. 17. As is apparent, the monorail track configuration used with this version of vehicle 240 is changed substantially by eliminating the metallic strip conductors in flanged recesses extending along the sides of the monorail. In this embodiment, the monorail track 250 is an extruded length of material defining a slot 252 extending along the bottom longitudinal edge thereof, a centrally located longitudinally-extending passage 254 and an upper longitudinally extending passage 256 of a smaller dimension located interiorly of and immediately adjacent the upper longitudinal edge of the track.

The vehicle 240 in this embodiment of the invention comprises a yoke assembly 242, a dry cell battery 244, a D-C drive motor 246 and a gear drive gear assembly 248. Assembly 248 in this embodiment utilizes a drive wheel and idler wheel configuration. Wheels 258 and 260 depend from the drive gear assembly 248 and grip opposite sides of track 250. A slot 262 in yoke assembly 242 is adapted to be disposed over the top edge of track 250 and extend downwardly on both sides thereof. A pair of horizontally-disposed rollers 241,243 are located adjacent yoke assembly 242 and gear assembly 248, respectively, to provide rolling support for the vehicle on top of monorail 250. The yoke assembly 242 provides stability for the front end of the vehicle. In an alternate embodiment, the yoke assembly and drive wheel assembly positions are reversed resulting in the same stability at the front and rear of the vehicle.

A control switch assembly 264 is mounted on top of the drive motor 246. Assembly 264 includes a flat blade-shaped switch member 266, one free end of which extends exteriorly of the housing 268 of the vehicle through a slot 270. D-C electrical energy is transmitted to the drive motor from the battery 244 by means of electrical conductors 272,274 which are connected to switch assembly 264. Depending on the position of the switch member 266, energy is selectively transmitted from the battery to the poles of motor 246. In one embodiment, battery 244 is a 1.5 volt dry cell. By moving member 266 to the forward position, the vehicle is caused to be driven in the forward direction due to electric current flow in a first direction. By moving the member 266 to the rear position, the vehicle is caused to be driven in the reverse direction due to electric current flow in the opposite direction. The center position of the blade-shaped member 266 is the "off" position. Other electrical power packs and energy cells are also contemplated for use with this embodiment of the invention. By providing a multi-position switch connected to a potentiometer in the vehicle, control of the speed of this vehicle is also obtained.

An adapter module or assembly 276 is shown in FIG. 16 in position to be connected to the end of the monorail track member 250. As seen therein, the module consists of a vertical support member 278 through which an upper arm 280 is passed. Arm 280 is shaped and sized to fit and be received within passage 256. A second arm 282 also extends through support 278 below arm 280 and is adapted to be received in passage 254. A lower arm 284 is likewise supported by and extends through support 278, and is adapted to engage slot 252.

The details of the switch assembly 264 are shown in FIG. 17. Electrical conductors 272,274 from the battery are connected to terminals 291,293 on the switch assembly. Member 266 includes a shank portion 286 from which depend two tab-like extensions 288,290. Tabs 288 and 290 are spaced such that, when shank 286 is secured to base plate 292 by means of a fastener passing through apertures 294 and 295, the tabs seat on conductive cross arm members 296 and 298, respectively, between arched end portions 300,302 and 301,303, respectively.

Members 296,298 are tightly secured to base 292 by fasteners passing through a central aperture in each arm and into upwardly extending bosses 297,299. Bosses 297,299 elevate arms 296,298 slightly such that they are out of electrical contact with conductive strips 304,306 when switch 266 is in the "off" or center position. Conductors 305,307 connect from bosses 297,299 which are also electrical terminals to the poles of motor 246.

Moving switch arm 266 in one direction (reverse) causes tab 288 to contact and depress arched end 300 of cross member 296 and causes tab 290 to contact and depress arched end 303 of cross member 298. Depression of ends 300,303, in turn, causes cross members 296,298 to contact conductive strips 304 and 306, respectively, causing electrical energy from the battery to flow through the poles of the motor in one direction and drive the vehicle in reverse. Moving the switch arm 266 in the opposite direction (forward) causes end 302 of cross member 296 and 301 of cross member 298 to engage conductive strips 304 and 306, respectively, causing current to flow through the motor in the opposite direction, thereby producing opposite rotation of the motor and motion in the opposite (forward) direction. Switch 266 wedges tabs 288,290 against the arched end portions of cross members 296,298 to hold the switch in the forward or reverse position until normally released.

In addition to the applications previously described, the system of the present invention can also be used to simulate a space station or interplanetary transport system. Because of the ample power available and good traction obtainable, the vehicles of the system are capable of climbing steep inclines and traversing curves and turns at angles from the vertical of 45°. Because of the unique drive system, a single car or a multiplicity can be driven over the system.

While described in the context of a miniature monorail system suitable for toy and amusement applications, the present invention and the principles embodied therein are directly applicable to full-scale, people-moving systems. Suitable structural adjustments would be necessary to accommodate the substantially increased weights and forces involved in a full-scale, life-size embodiment, but the use of, for example, a thin monorail of the support type having conductive strips placed in longitudinally-extending recesses is entirely feasible. With suitable scaling up, the vehicle of the present invention can likewise be designed to accommodate adult-size passengers.

What is claimed is:

1. A monorail system comprising a length of flat material defining a monorail have a recess extending longitudinally of the length of material on each side thereof, the material being relatively flexible about its lateral axis and relatively rigid about its longitudinal axis;

a flexible conductive strip mounted in each recess, each strip being freely and independently slidable in its respective recess;

a vehicle movably mounted on one longitudinal edge of the monorail, said vehicle including a plurality of elongated horizontal rollers attached to and supporting said vehicle on the upper edge of the monorail;

motor means located within the vehicle;

contact means mounted on the vehicle for establishing electrical contact with the conductive strips and transmitting electrical power from the conductive strips to the motor means;

drive means mounted on the vehicle in frictional contact with the monorail;

means for transmitting mechanical drive force from the motor means to the drive means; and means for transmitting electric power from a source of electrical power to the conductive strips.

2. A monorail system according to claim 1 wherein the electric power transmitting means includes connecting means conductively-linked between the conductive strips and a source of electric power.

3. A monorail system according to claim 2 including power limiting means connected to the connecting means for controlling the amount of electrical power supplied to the motor means.

4. A monorail system according to claim 3 wherein the power limiting means is a slide wire potentiometer.

5. A monorail system according to claim 4 including D-C transformer means connected between the source of electric power and the connecting means for converting conventional A-C power to D-C power for transmission to the motor means.

6. The monorail system according to claim 5 wherein the motor means is a D-C motor.

7. A monorail system according to claim 2 wherein the connecting means includes switching means for reversing the direction of travel of the vehicle.

8. A monorail system according to claim 1 wherein the monorail includes a slot extending longitudinally along the bottom edge thereof.

9. A monorail system according to claim 8 including support means for the monorail, said support means including means for engaging the slot in the lower edge of the length of monorail.

10. A monorail system according to claim 9 wherein the support means includes riser elements for elevating the monorail.

11. A monorail system according to claim 1 including track switching means for directing the vehicle along one of a plurality of alternative selections of monorail track.

12. A monorail system according to claim 1 including adapter means for joining free ends of the monorail to provide a closed loop system, said adapter means including extensions for providing mechanical engagement with the free ends of the monorail and for establishing electric contact with the conductive strips in each recess along the sides of the monorail whereby a closed, self-supporting, edge-mounted monorail loop is provided.

13. A monorail system according to claim 1 wherein the rollers are circular shafts having an axial dimension greater than the diametrical dimension.

14. A monorail vehicle for use with a flat, thin monorail of the undersupport type comprising a vehicle chassis;

an electric contact assembly mounted on the chassis of the vehicle and extending downwardly along the monorail;

a tractor assembly mounted on the chassis of the vehicle depending from the chassis for gripping the monorail;

rolling means mounted on the chassis for supporting the vehicle in rolling contact on the monorail, said rolling means being elongated along the axis of rotation to provide a moving point of contact on the upper edge of the monorail on which the vehicle is mounted as the vehicle moves along a curved section of the monorail;

electric motor means mounted on the chassis connected to the contact assembly; and drive means linking the motor means and the tractor assembly for supplying mechanical drive power to the tractor assembly.

15. A vehicle according to claim 14 wherein the contact assembly is a yoke-like configuration having a centrally-located slot and a pair of spring-biased electric contacts extending into the slot from the opposite sides thereof for contacting conductive strips located in the sides of the monorail.

16. A monorail system according to claim 14 wherein the tractor assembly is a pair of vertically-oriented rollers mounted on shafts extending from the drive means, the rollers being adapted to be located on opposite sides of the monorail and to grip the flat side surfaces of the monorail.

17. A vehicle according to claim 16 wherein the rolling means is a pair of elongated thin circular shafts extending transversely of the chassis of the vehicle.

18. A vehicle according to claim 17 including spring biasing means urging the rollers of the tractor assembly into frictional contact with the side surfaces of the monorail.

19. A vehicle according to claim 18 wherein the electric contacts and rollers are shaped to receive the flat, thin monorail therebetween.

20. A vehicle according to claim 19 wherein the electric contact assembly is located at the front end of the vehicle and shaped to guide and vertically position the front end of the vehicle on the monorail and the tractor assembly is located at the rear end of the vehicle and shaped to guide and vertically position the rear end of the vehicle on the monorail.

21. A vehicle according to claim 16 wherein the drive means is a belt drive linkage interconnecting the electric motor means and at least one shaft of one of the rollers of the tractor assembly.

22. A vehicle according to claim 16 wherein the drive means is a two belt linkage having one belt interconnecting the electric motor and a first driven pulley fixed to a first shaft supported by two fixed bearings, said shaft having a first of said pair of rollers of the tractor assembly mounted thereon for providing primary drive force for the vehicle and a second belt interconnecting the electric motor and a second driven pulley fixed to a shaft supported by a fixed bearing and a slotted bearing, said second shaft having a roller of the tractor assembly mounted thereon and spring biased toward the primary drive wheel for providing secondary drive force for the vehicle.

23. A vehicle according to claim 16 wherein the drive means is a worm gear linkage interconnecting the electric motor means and the shaft of one of the rollers of the tractor assembly to provide a primary drive roller, said shaft being mounted in fixed bearings to insure alignment of the roller with the vertical side of the monorail.

24. A vehicle according to claim 23 wherein the worm gear linkage and an auxiliary gear linkage interconnects the electric motor means and a second shaft on which a roller is mounted to provide a secondary driver roller, said second shaft being mounted in a fixed bearing and a slotted bearing and being spring biased toward the primary driver roller to enhance engagement of the rollers with the vertical sides of the monorail.

25. A vehicle according to claim 14 wherein the motor means is a DC motor mounted on the chassis with the drive shaft extending upwardly in a vertical plane, said shaft being operatively linked to the drive means.

26. A monorail comprising a length of elongated thin material, flexible about its lateral axis and rigid about its longitudinal axis;

a recess extending longitudinally along each side of the length of the material;

an electrically conductive strip slidably disposed in each recess, each recess including overlapping flanges for confining the conductive strips in said recesses;

means for joining the free ends of the length of material to provide a closed, self-supporting, edge mounted monorail loop; and an endless slot in the underside of the monorail track extending longitudinally thereof.

27. A monorail track according to claim 26 including a predetermined short length of an electrically-conductive auxiliary strip located in each recess at each free end of the monorail track, said auxiliary strip being fixed in position such that said strips are flush with the free ends of the length of the monorail track and overlap a predetermined length of the conductive strips slidably disposed in said recesses in an electrically-conductive relationship therewith.

28. A monorail track according to claim 27 wherein a web is located between the recesses in the elongated, thin material, said web being milled out at the free ends thereof.

29. A monorail track according to claim 27 wherein the means for joining is an adapter assembly including means for slidably engaging the recesses and auxiliary strips.

30. A monorail track according to claim 29 wherein the adapter assembly includes a pair of conductive extensions adapted to be slidably received in the recesses at each side of the monorail and to be in sliding electrical contact with the conductive strips in the recesses.

31. A monorail track according to claim 30 wherein the adapter assembly includes a third extension adapted to be slidably engaged in the underside slot to provide a closed, self-supporting, edge-mounted monorail loop.

32. A monorail system according to claim 31 including means for joining the free ends of the monorail to provide a closed, self-supporting, edge-mounted monorail loop.

33. A monorail system comprising a length of flat material defining a monorail, the material being relatively flexible about its lateral axis and relatively rigid about its longitudinal axis;

a vehicle mounted on a longitudinal edge of the monorail;

a pair of elongated rollers extending laterally of the vehicle and transversely of the longitudinal axis of the monorail, said rollers supporting the vehicle on the longitudinal edge of the monorail;

motor means located within the vehicle;

drive means mounted on the vehicle in frictional contact with the monorail;

a source of electric power located within the vehicle connected to the motor means; and means for transmitting mechanical drive force from the motor means to the drive means.

34. A system according to claim 33 wherein the source of electric power is battery-mounted within the vehicle.

35. A system according to claim 34 including switch means for controlling the supply of electric power to the motor means.

36. A system according to claim 35 wherein the motor means is a D-C electric motor and the switch means has a plurality of positions for selectively supplying battery power to drive the motor in a forward or reverse mode.

37. A monorail track comprising a length of elongated thin material, flexible about its lateral axis and rigid about its longitudinal axis;

a recess extending longitudinally along each side of the length of the material;

a first passage extending longitudinally through the interior of the track, the passage being located generally midway between the upper and lower edges of the track and a second longitudinal passage extending through the track, said second passage being located interiorly of and immediately adjacent to the upper longitudinal edge of the track.

* * * * *